United States Patent [19]

Beck

[11] Patent Number: 4,998,478

[45] Date of Patent: Mar. 12, 1991

[54] CONNECTION DEVICE FOR BLASTING SIGNAL TRANSMISSION TUBING

[75] Inventor: Michael W. Beck, Ayrshire, England

[73] Assignee: Imperial Chemical Industries plc, London, England

[21] Appl. No.: 485,872

[22] Filed: Mar. 1, 1990

[30] Foreign Application Priority Data

Mar. 1, 1989 [GB] United Kingdom ..... 8904660

[51] Int. Cl.[5] ..... C06C 5/04

[52] U.S. Cl. ..... 102/275.7; 102/275.12

[58] Field of Search ..... 102/275.7, 275.12, 275.2, 102/275.3, 275.4, 275.6, 275.8, 275.9, 275.11

[56] References Cited

U.S. PATENT DOCUMENTS

| | | | |
|---|---|---|---|
| 1,652,961 | 12/1927 | Snelling | 102/275.7 |
| 3,438,325 | 4/1969 | Martin | 102/314 |
| 4,699,059 | 10/1987 | Kelly et al. | 102/275.7 |
| 4,716,831 | 1/1988 | Bartholomew et al. | 102/275.7 |
| 4,730,560 | 3/1988 | Batholomew et al. | 102/275.7 |
| 4,771,694 | 9/1988 | Bartholomew et al. | 102/275.7 |
| 4,821,645 | 4/1989 | Reiss | 102/275.7 |

*Primary Examiner*—David H. Brown

*Attorney, Agent, or Firm*—Cushman, Darby & Cushman

[57] ABSTRACT

A connection device for blasting signal transmission tubing comprises a housing consisting of first and second hinged section (1, 2) provided with cooperating arcuate raised portions (3, 5) and grooves (4, 6) which, when the housing is closed, define first and second arcuate, circular-section channels, interconnected by a further channel (8). In use, first and second lengths of transmission tube are located in the arcuate channels and are partially cut by a blade (10) mounted in the connecting channel (8) to form apertures therein, whereby a portion of a blasting signal entering the connector via one of the tubes will spill out of that tube, traverse the connecting channel (8), and initiate a signal in each arm of the other tube.

26 Claims, 3 Drawing Sheets

CONNECTION DEVICE FOR BLASTING SIGNAL TRANSMISSION TUBING

The present invention relates to a self-contained device for connecting lengths of blasting signal transmission tubing in such a manner that a blasting signal may be transmitted from one such length of tubing to another.

Transmission tubing has advantages in cost, ease of use and manufacture, safety, delay precision, noise reduction and bottom hole initiation over conventional detonation cord.

The most common form of transmission tubing currently in use is that disclosed in U.S. Pat. No. 3,590,739 and sold under the tradename "NONEL" (a trademark of Nitro-Nobel AB, Sweden). Such tubing, often referred to as "shock tube", typically has an inner diameter of 1.5 mm and an outer diameter of 3.0 mm, and contains a small quantity of explosive material coated on the inner surface of the plastic tube. This material is typically a mixture of a secondary explosive commonly referred to as HMX and fine aluminium flakes in the Mass ratio 42:3 and at coreloadings of around 16 $mgm^{-1}$. A shock wave will typically propagate at 2000 $ms^{-1}$ in NONEL tubing and will be contained within the confines of the tube.

The fact that NONEL tubing has little effect on the environment and is itself not easily influenced by its surroundings, does however pose a problem in its application in initiating systems, since it is very difficult to form a simple junction or connection between two or more lengths of tubing.

A plurality of detonating cords may be readily connected by simply tying the line ends together. In comparison the connection of a plurality of transmission tubes requires intimate splicing, or the use of a detonator or similar device at the point of intersection. This difficulty has resulted in NONEL tubing being employed in conjunction with detonating cords in most applications.

NONEL tubing has for example been used with end caps (detonators) in surface trunklines with detonating cords as downlines, if surface noise is a major consideration. Alternatively, detonating cords have been used as surface lines with NONEL tubing downlines, if bottom hole initiation is desired.

A number of applications have attempted to utilise NONEL tubing to simultaneously derive the benefit of bottom hole initiation and a reduction in air-blast. Such systems however require detonators at all junction points and usually consist of made up units of specific lengths of tubing with detonators attached at both ends. Initiation systems based entirely on NONEL tubing interspersed with detonators have therefore not been as cost effective, versatile or simple to use as hybrid systems based on detonating cords and transmission tubes.

The aforementioned difficulty in obtaining cross-propagation between transmission tubes has therefore hampered the introduction of initiation systems based on such tubing.

A transmission tubing connector should have the following desirable characteristics if it is to be acceptable in practice:

(a) the device should be omni-directional and capable of reliably transmitting a signal between the connected tubes;

(b) the device must be watertight and should not allow the ingress of any foreign matter which might impede the performance of the tubing; e.g. water, which may cause the signal to dissipate;

(c) the connection should be robust and capable of withstanding the reasonably high tensile stresses experienced in the field;

(d) the device should be simple to use and should not contain too many components or be unnecessarily bulky or too small to handle;

(e) the device should address the problem of unprotected cut ends (e.g. left on the spool) which may be liable to contamination;

(f) the device should preferably not contain any explosive material.

To date, three methods for the formation of transmission tube junctions have been proposed. These are: allowing the tube to rupture, cutting the tubing before connection and simultaneous cut-and-connection.

The first of these methods, proposed in U.S. Pat. No. 4,699,059, involves the introduction of weakened regions along the length of the tubing to allow the signal to "spill-out", and thus provide "tap-in" points.

This method of connection is however likely to be unreliable in allowing cross propagation through the weakened region, since the signal (shock wave) requires to undergo a perpendicular change in direction of propagation. The device is also not truly omni-directional.

The second method, i.e. cutting the tubing before connection, involves cutting standard tubing to the required length in the field and then obtaining a junction by means of a connector. The connection obtained is watertight, robust, simple, cost effective and safe. However, the connector tends to be small and difficult to handle. Also the tubing requires to be cut prior to insertion into the connector, thus exposing the interior of the tube to the environment.

It would therefore seem to be desirable to incorporate the cutting and connection steps within a single device. The device disclosed in U.S. Pat. No. 4,771,694 is one such device. In this device the tubes to be connected are positioned parallel to one another and, by means of a blade mechanism incorporated within the device housing, a segment is removed from each of the tubes. In this arrangement however, little can be done to encourage an even distribution of the incoming signal between the acceptor tubes, especially tubes extending from the connector in an anti-parallel direction from that of the incoming signal tube. It is therefore highly probable that one or more of the acceptor tubes will not be initiated.

It is an object of the present invention to obviate or mitigate the aforementioned disadvantages.

It is a further object of the present invention to provide a connector incorporating the aforementioned desirable characteristics.

Accordingly, the present invention provides a transmission tube connector comprising:

a housing adapted to enclose a portion of a first length of transmission tube and a portion of a second length of transmission tube disposed relative to one another such that the passage of a blasting signal along one of said tubes causes initiation of a blasting signal in the other of said tubes, and including retaining means for retaining said portions in said relative disposition, wherein said retaining means are adapted to maintain each of said portions in a predetermined arcuate configuration such that the apexes of said arcs face one another and whereby an aperture formed in each of said tube portions at a position corresponding to said apexes will allow a portion of a blasting signal travelling along said first length of transmission tube to exit said first length via the aperture formed therein and to enter said second length of transmission tube via the aperture formed therein, thereby initiating a blasting signal in said second length.

Preferably, the connector further includes cutting means for forming said apertures in said first and second tube portions.

Preferably also, said housing comprises first and second housing sections which cooperate to enclose and retain said tube portions in said predetermined arcuate configuration.

Preferably also, said retaining means comprises first and second arcuate grooves formed in said second housing section, adapted to receive said tube portions and defining said predetermined arcuate configuration, the apexes of said grooves being interconnected by a connecting channel by means of which said portion of said blasting signal may pass from one tube portion to the other, said grooves each having first and second open ends terminating at an edge of the housing.

Said first housing section is preferably also provided with first and second arcuate raised portions which cooperate with the arcuate channels of the second housing section to define first and second arcuate, circular-section channels when the first and second housing sections are assembled.

It is further preferred that said first and second housing sections are hingeably connected together along one edge, and further including fastening means for retaining said housing sections in a closed configuration.

The cutting means preferably comprises a blade carrier adapted to be mounted in said connecting channel and having a blade extending downwardly into said channel and projecting into said first and second grooves at the apexes thereof.

Preferably also, at least a portion of said first and second grooves and/or said first and second raised portions have a non-slip, waterproof material applied thereto.

Preferably also, said first and second housing sections are further provided with cooperating guide pins and guide holes.

The connector housing is preferably moulded in one piece from plastics material, and may further include interengaging formations formed integrally with the first and second housing sections, whereby the connector housing may be locked in a closed position.

It is further preferred that the apexes of said arcs are spaced apart by approximately two tube diameters, and that said arcs each describe a part-ellipse having a semimajor axis extending perpendicular to the apexes of said arcs.

Embodiments of the invention will now be described, by way of example only, with reference to the accompanying drawings in which.

The transmission tubes themselves are omitted from FIGS. 1, 3, 4 and 5 for the sake of clarity.

Figure 1:
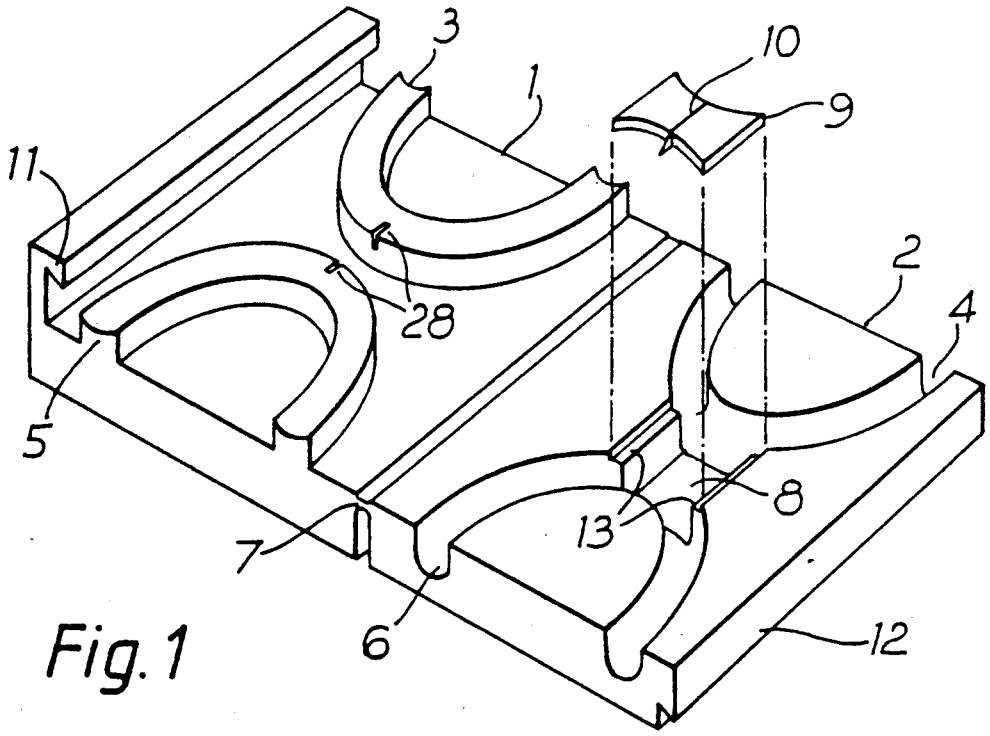
FIG. 1 is a partially exploded, schematic perspective view of a device embodying the invention, shown in an open position.

Referring firstly to FIG. 1 of the drawings, a connector device embodying the invention comprises first and second housing sections 1 and 2 connected together along one edge by a hinge 7. The second housing section 2 is provided with first and second arcuate grooves 4 and 6, each having first and second open ends terminating at opposite edges thereof adjacent the hinge 7, and each extending between said open ends to define an apex adjacent the middle of the section. The bottom of each of the grooves is concave and part circular in cross-section, and their respective apexes are linked by a substantially rectangular connecting channel 8.

The first housing section 1 is provided with complementary, first and second arcuate raised portions 3 and 5, corresponding in shape and position to the grooves 4 and 6 of the second section 2. The tops of the raised portions 3 and 5 are also concave and part-circular in cross-section such that when the housing sections 1 and 2 are folded together about the hinge 7 the grooves 4 and 6 and raised portions 3 and 5 cooperate to define first and second arcuate, circular-section channels within the connector, interconnected at their apexes by the connecting channel 8.

The connector further includes a blade carrier 9, comprising a generally planar, shaped member which supports a blade 10. In use, the blade carrier 9 spans the connecting channel 8 and is supported on shoulders 13 formed along either upper, lateral edge thereof. When in position, the blade 10 extends downwardly into the connecting channel 8, parallel to the hinge 7, with its ends projecting beyond the carrier 9 into the grooves 4 and 6 at the apexes thereof. The raised portions 3 and 5 may be further provided with notches 28 at their apexes, to accommodate the projecting ends of the blade 10 when the connector is closed.

The connector is preferably moulded in one piece from plastics material, the hinge 7 being formed integrally with the housing sections 1 and 2. Cooperating formations 11 and 12 may also be formed along the edges of the housing sections 1 and 2 opposite the hinge 7, which interengage upon enclosure of the connector to maintain it in a closed position.

The use of the connector will now be described with further reference to FIG. 2.

In use, first and second lengths of blasting signal transmission tubes 22 and 23 are located in the grooves 4 and 6 and are partially cut by the blade 10, the curvature of the tubes causing the slits formed by the blade 10 to open up creating coupling apertures 24 and 25 in the respective tubes at the apexes of the grooves 4 and 6. The manner in which the cutting of the tubes 22 and 23 is effected depends upon the precise mode of operation. For example, the tubes 22 and 23 may be located in the grooves 4 and 6, and the blade carrier 9 subsequently pressed into position in the connecting channel 8. Alternatively, the blade carrier 9 might be inserted prior to the tubes 22 and 23 being partially located in the grooves 4 and 6, such that the apexes of the curved tubes 22 and 23 are forced past the blade 10 and into position below the blade carrier 9 upon closure of the connector.

The blade is positioned and dimensioned so as to cut approximately half way through the tubes 22 and 23; i.e. sufficiently to allow adequate apertures to be formed for proper operation of the connector without compromising the integrity or tensile strength of the tubes 22 and 23.

Figure 2:
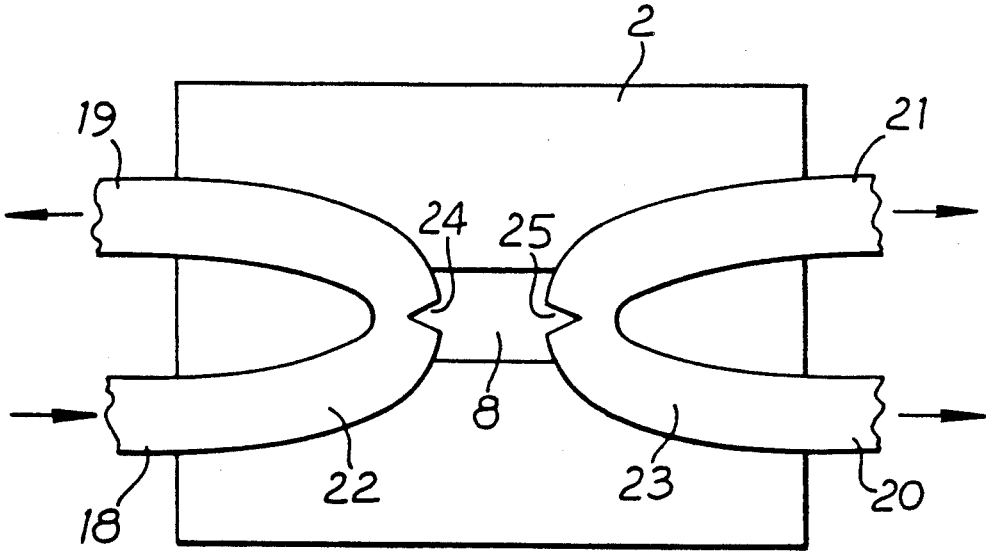
FIG. 2 is a plan schematic view of the device of FIG. 1, illustrating the operation and use thereof.

When the tubes 22 and 23 are located and the connector cut, portions of the tubes 22 and 23 are enclosed within the channels defined by the grooves 4 and 6 and raised portions 3 and 5, with their free ends 18, 19 and 20 and 21 extending from opposite edges of the connector and with their respective apertures 24 and 25 facing one another, as is illustrated schematically in FIG. 2.

The connector is so configured and dimensioned that approximately half of a blasting signal entering the connector from, say, the end 18 of the first tube 22 will continue past the aperture 24 and exit from the connector at end 19, whilst the remainder will spill out of the aperture 24, traverse the connecting channel 8, and initiate signals in both arms of the second tube 23 via aperture 25 (as indicated by the arrows in FIG. 2). Relevant factors in achieving proper operation of the connector are the degree of curvature of the tubes 22 and 23 and the spacing of their apexes.

If the radius of curvature of the tubes is too small, the signal in the first, "initiating" tube 22 is found to preferentially favour the second, "receptor" tube, at the expense of the continuing arm of the initiating tube 22. At greater radii, transmission is favoured along the continuing arm of the initiating tube 22, thus increasing the probability of failure of the receptor tube 23 to initiate. In the extreme case of two parallel tubes, failure to cross-propagate is virtually assured. The radius of curvature is optimised to allow the apertures 24 and 25 to open up sufficiently to achieve the desired effect. It will be appreciated that, owing to the symmetry of the connector, it is immaterial which tube is the initiating tube and which is the receptor, and which arm of the initiating tube is used as the "input" to the device.

The distance between the apexes of the curved tubes 22 and 23 is kept to a minimum since the connecting channel 8 does not contain any energetic material, and will not sustain the propagating reaction over long distances. If this distance is too short, however, insufficient dispersion of the signal may result in one arm of the receptor tube 23 being favoured over the other, and if the first and second tubes 22 and 23 are placed in contact with one another it is found that the signal propagates in a straight line so that only the arm of the receptor tube 23 diametrically opposite the "input" arm of the initiating tube 22 is initiated. In this case the other arm of the receptor tube 23 is substantially perpendicular to the incoming signal and will tend to fail to initiate in the majority of cases.

Separating the tubes by approximately two tube diameters allows the cross propagating signal to be deflected off the two side walls of the connecting channel 8, which aids dispersion of the signal and assists in optimising the performance of the connector.

The surfaces of the grooves 4 and 6 and raised portions 3 and 5 are also preferably coated with a non-slip, waterproofing material, to prevent slippage of the tubes 22 and 23 (and hence misalignment of the apertures 24 and 25) once the connector is closed, and to prevent the ingress of water or other foreign matter. Virtually any elastic, rubber-like material capable of being deformed and so clinging to the plastic tubing would be potentially suitable for this purpose. Ethylene propylene rubber has been found to be particularly suitable, although silicon bond rubbers may also be used. Further, the blade arrangement described herein for cutting the tubes does not contain any moving parts liable to provide channels for the ingress or retention of foreign matter.

Figure 3:
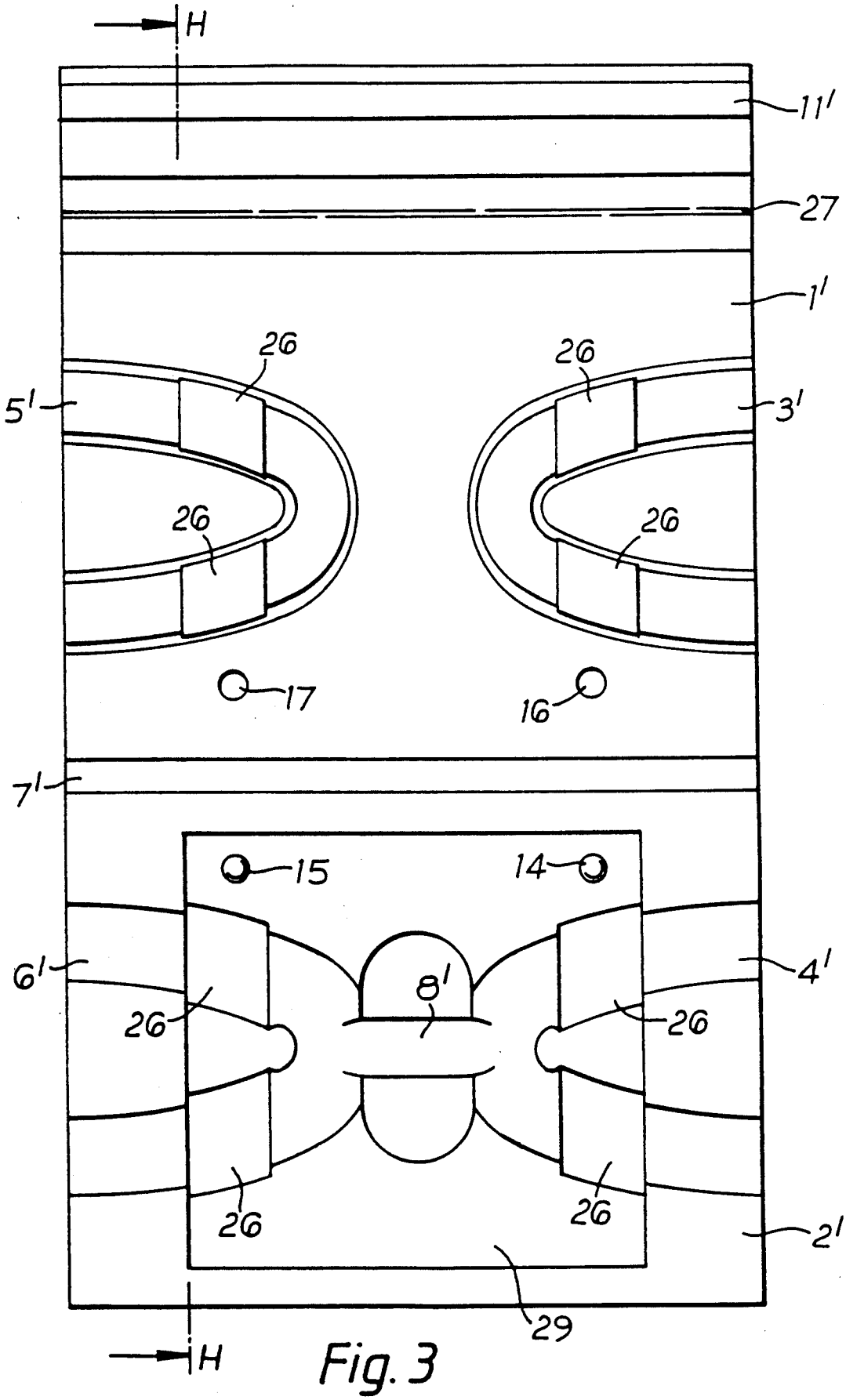
FIG. 3 is a plan view of a preferred embodiment of a housing of a connector embodying the invention, shown in an open position.
Figure 4:
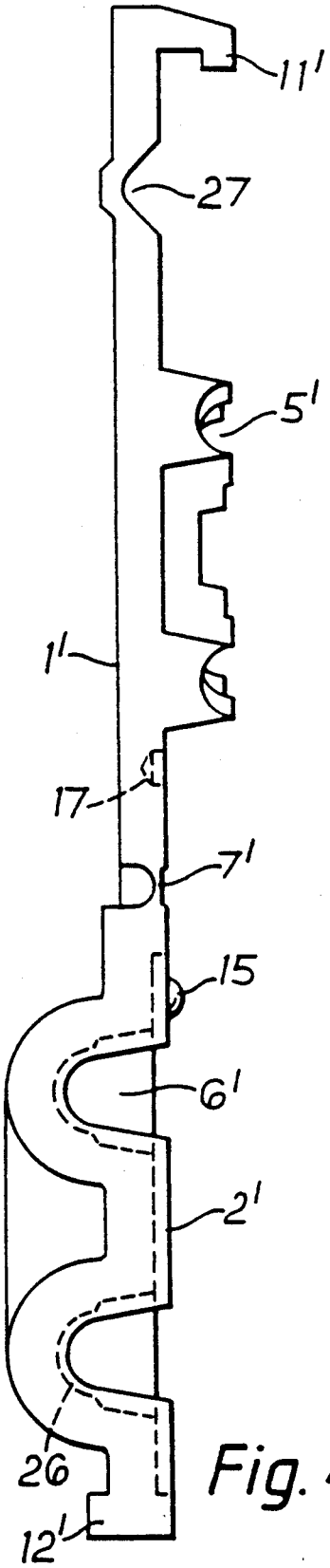
FIG. 4 is a side view of the housing of FIG. 3, again in the open position.
Figure 5:
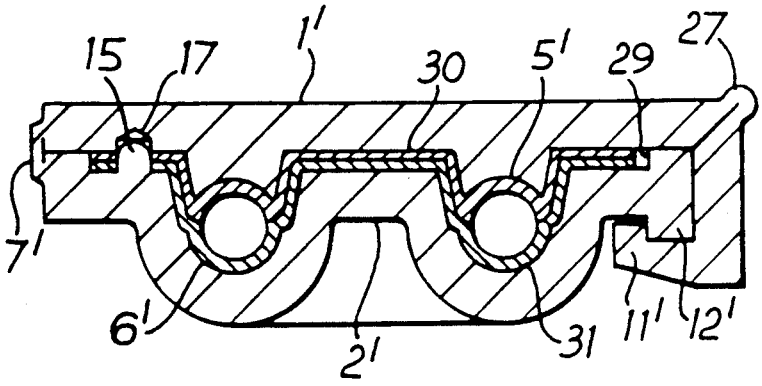
FIG. 5 is a sectional side view taken on line H—H of FIG. 3, but with the housing in a closed position.

FIGS. 3, 4 and 5 illustrate a preferred embodiment of a connector housing embodying the invention, wherein features corresponding to features of FIGS. 1 and 2 are designated 1', 2', 3' etc. This embodiment is particularly intended for use with NONEL tubing as described in the introduction hereto, and, with regard to the design considerations discussed above, the curvature of the grooves 4' and 6' and the raised portions 3' and 5' describes a part-ellipse with a semimajor axis of 30 mm and a semiminor axis of 12 mm, whilst the central axes thereof are separated by 9.5 mm at their closest point.

The housing is again moulded in one piece from plastics material, but is shaped so as to reduce the amount of material required in comparison with the simplified embodiment of FIG. 1. The grooves 3' and 5' and raised portions 4' and 6' are provided with recesses 26, and the second housing portion 2' with a larger recess 29, to accommodate non-slip, waterproofing material in the form of suitable gaskets 30 and 31 (FIG. 5). These might suitably be punched from 0.5 mm rubber sheet and bonded to the housing sections 1' and 2' by means of a suitable adhesive. Corresponding guide pins 14 and 15 and guide holes 16 and 17 are also included to provide positive positioning of the housing sections 1' and 2' when closed, and the closure clip formation 11' of the first housing section 1' is hinged at 27.

The device described herein provides a simple and reliable blasting signal transmission tube connector, embodying many, if not all, of the desirable characteristics of such a connector. It will be appreciated that the precise configuration and dimensions of the connector may have to be varied to suit the particular type of tubing with which it is intended to be used, and that numerous modifications and variations of the illustrated embodiments are possible without departing from the scope of the invention.

What is claimed is:

1. A blasting signal transmission tube connector comprising a housing adapted to enclose a portion of a first length of transmission tube and a portion of a second length of transmission tube, and including retaining means for retaining said portions adjacent one another, each in a predetermined arcuate configuration such that the apexes of said arcs face one another and whereby an aperture formed in each of said tube portions at a position corresponding to said apexes enables a portion of a blasting signal travelling along said first length of transmission tube to exit said first length via the aperture formed therein and to enter said second length of transmission tube via the aperture formed therein, thereby initiating a blasting signal in said second length.

2. A connector as claimed in claim 1, wherein there are provided cutting means for forming said apertures in said first and second tube portions.

3. A connector as claimed in claim 1, wherein the apexes of said arcs are spaced apart by approximately two tube diameters.

4. A connector as claimed in claim 1, wherein said arcs each describe a part-ellipse having a semimajor axis extending perpendicular to the apexes of said arcs.

5. A connector as claimed in claim 1, wherein said housing comprises first and second housing sections which cooperate to enclose and retain said tube portions in said predetermined arcuate configuration.

6. A connector as claimed in claim 5, wherein there are provided cutting means for forming said apertures in said first and second tube portions.

7. A connector as claimed in claim 5, wherein said first and second housing sections are hingeably connected together along one edge, and further including fastening means for retaining said housing sections in a closed configuration.

8. A connector as claimed in claim 5, wherein said first and second housing sections are further provided with cooperating guide pins and guide holes.

9. A connector as claimed in claim 5, wherein the apexes of said arcs are spaced apart by approximately two tube diameters.

10. A connector as claimed in claim 5, wherein said arcs each describe a part-ellipse having a semimajor axis extending perpendicular to the apexes of said arcs.

11. A connector as claimed in claim 5, wherein the connector housing is moulded in one piece from plastics material.

12. A connector as claimed in claim 11, wherein interengaging formations are formed integrally with the first and second housing sections, whereby the connector housing may be locked in a closed position.

13. A connector as claimed in claim 5, wherein said retaining means comprise first and second arcuate grooves formed in said second housing section, and adapted to receive said tube portions and defining said predetermined arcuate configuration, the apexes of said grooves being interconnected by a connecting channel by means of which said portion of said blasting signal may pass from one tube portion to the other, said grooves each having first and second open ends terminating at an edge of the housing.

14. A connector as claimed in claim 13, wherein said first housing section is provided with first and second arcuate raised portions which cooperate with the arcuate channels of the second housing section to define first and second arcuate, circular-section channels when the first and second housing sections are assembled.

15. A connector as claimed in claim 13, further including a blade carrier adapted to be mounted in said connecting channel and having a blade extending downwardly into said channel and projecting into said first and second grooves at the apexes thereof.

16. A connector as claimed in claim 13, wherein at least a portion of said first and second grooves and/or said first and second raised portions have a non-slip, waterproof material applied thereto.

17. A blasting signal transmission tube connector comprising a housing adapted to enclose a portion of a first length of transmission tube and a portion of a second length of transmission tube, and including retaining means for retaining said portions adjacent one another, each in a predetermined arcuate configuration such that the apexes of said arcs face one another and whereby an aperture formed in each of said tube portions at a position corresponding to said apexes will allow a portion of a blasting signal travelling along said first length of transmission tube to exit said first length via the aperture formed therein and to enter said second length of transmission tube via the aperture formed therein, thereby initiating a blasting signal in said second length, further including cutting means for forming said apertures in said first and second tube portions, said housing comprising first and second housing sections which cooperate to enclose and retain said tube portions in said predetermined arcuate configuration, and wherein said retaining means comprises first and second arcuate grooves formed in said second housing section, adapted to receive said tube portions and defining said predetermined arcuate configuration, the apexes of said grooves being interconnected by a connecting channel by means of which said portion of said blasting signal may pass from one tube portion to the other, said grooves each having first and second open ends terminating at an edge of the housing.

18. A connector as claimed in claim 17, wherein the apexes of said arcs are spaced apart by approximately two tube diameters.

19. A connector as claimed in claim 17, wherein said arcs each describe a part-ellipse having a semimajor axis extending perpendicular to the apexes of said arcs.

20. A connector as claimed in claim 17, wherein said first housing section is provided with first and second arcuate raised portions which cooperate with the arcuate channels of the second housing section to define first and second arcuate, circular-section channels when the first and second housing sections are assembled.

21. A connector as claimed in claim 17, wherein said first and second housing sections are hingeable connected together along one edge, and further including fastening means for retaining said housing sections in a closed configuration.

22. A connector as claimed in claim 17, wherein there is provided blade carrier adapted to be mounted in said connecting channel and having a blade extending downwardly into said channel and projecting into said first and second grooves at the apexes thereof.

23. A connector as claimed in claim 17, wherein at least a portion of said first and second grooves and/or said first and second raised portions have a non-slip, waterproof material applied thereto.

24. A connector as claimed in claim 17, wherein said first and second housing sections are further provided with cooperating guide pins and guide holes.

25. A connector as claimed in claim 17, wherein the connector housing is moulded in one piece from plastics material.

26. A connector as claimed in claim 17, wherein interengaging formations are formed integrally with the first and second housing sections, whereby the connector housing may be locked in a closed position.

* * * * *